US006528708B2

(12) United States Patent
Konishi et al.

(10) Patent No.: US 6,528,708 B2
(45) Date of Patent: Mar. 4, 2003

(54) EXTERIOR STRUCTURE FOR ELECTRONIC KEYBOARD INSTRUMENT

(75) Inventors: Keiji Konishi, Shizuoka-ken (JP); Takahiro Tajima, Shizuoka-ken (JP); Katsuhiko Torii, Shizuoka-ken (JP); Tadayuki Ishida, Shizuoka-ken (JP)

(73) Assignee: Kabushiki Kaisha Kawai Gakki Seisakusho, Shizuoka (JP)

( * ) Notice: Subject to any disclaimer, the term of this patent is extended or adjusted under 35 U.S.C. 154(b) by 33 days.

(21) Appl. No.: 09/879,910

(22) Filed: Jun. 14, 2001

(65) Prior Publication Data

US 2001/0052280 A1 Dec. 20, 2001

(30) Foreign Application Priority Data

Jun. 16, 2000 (JP) ..... 2000-181869

(51) Int. Cl.[7] ..... G10C 3/07
(52) U.S. Cl. ..... 84/177; 206/314; 181/198
(58) Field of Search ..... 84/177, 423 R; 206/314; 181/198, 199

(56) References Cited

U.S. PATENT DOCUMENTS 6,035,962 A * 3/2000 Lin ..... 181/148

FOREIGN PATENT DOCUMENTS

JP 2-95997 7/1990

JP 11-355875 12/1999

* cited by examiner

*Primary Examiner*—Jeffrey Donels
(74) *Attorney, Agent, or Firm*—Arent Fox Kintner Plotkin & Kahn, PLLC

(57) ABSTRACT

The present invention provides an exterior structure for an electronic keyboard instrument which has excellence in an outward appearance and which can be produced easily without detracting acoustic characteristics. In the present invention, a recess groove 9 extending in a direction in which keyboards 3 are arranged is formed at an upper portion of a back panel 4 of the electronic keyboard instrument 1, a locking edge 8*a* formed at an upper edge of a speaker cover 8 is fitted into the recess groove 9, and a lower edge of the speaker cover 8 is fixed to a lower portion of the back panel 4 by a screw 11. A lower portion of the back panel 4 is provided with a positioning stopper 4*d* which abuts against a back surface of a keybed 12 of the electronic keyboard instrument 1, and a fixing piece 4*e* which abuts against a lower surface of the keybed 12. A thick plate 14 having rigidness is provided around the periphery of the speaker-mounting hole 6. An outer surface of a back panel 4 is provided with a display 16 of character or the like, and the speaker cover 8 is formed into a size capable of covering substantially the entire surface of the back panel 4. The size, shape or angle of the holes of the porous speaker cover 8 differentiated at a front portion of a speaker 5 and at a front portion of the display.

9 Claims, 4 Drawing Sheets

EXTERIOR STRUCTURE FOR ELECTRONIC KEYBOARD INSTRUMENT

BACKGROUND OF THE INVENTION

1. Field of the Invention

The present invention relates to an exterior structure provided on an electronic keyboard instrument.

2. Description of the Related Art

Conventionally, there is a known electronic keyboard instrument provided at its back surface with a speaker, and it is also known to mount the speaker on a periphery of a speaker-mounting hole formed in a back panel of the electronic keyboard instrument. A width of the electronic keyboard instrument is about 130 cm, the back panel is made of wood, synthetic resin, aluminum extrusion-molded material or the like, and design such as characters or drawings is made on a surface of the back panel. A porous speaker cover such as a punching metal is provided in front of a wall surface of the back panel for protecting the speaker.

The speaker cover is generally mounted on the back panel through a mounting hardware, but when the mounting hardware is used, there is inconvenience that the number of parts is increased and the number of assembling steps is also increased. However, when the speaker cover is mounted using screw without using the mounting hardware, there is inconvenience that the screw is exposed outside to mar the outward appearance. Further, since the electronic keyboard instrument is formed relatively small, precise positioning is required correspondingly so that the mounted speaker does not interfere with movable portions such as keyboards to detract from the acoustic characteristics, and it is desired to meet the requirements easily. Further, it is preferable to use a thin member as the back panel in order to lighten the electronic keyboard instrument, but a thin back panel is prone to cause vibration, the vibration affects vibration of a diaphragm of the speaker, and the acoustic characteristics of the speaker is detracted. Further, a display such as characters or drawings printed on the back panel, contamination or flaw is prone to adhere there to, and in order to prevent such contamination or flaw from the adhesion, a thin transparent film is stuck on the display until sales. However, the sticking operation is troublesome, and the display is relatively monotone and does not attract attention of the customer. Further, when the electronic keyboard instrument is formed compact, a clearance (indicated with symbol a in FIG. 2) between the keyboard mounted to a keybed of the instrument and the electronic part mounted on the back panel becomes narrow, and it is necessary to assemble with high precision. But in the conventional mounting method of the back panel, the back panel is superposed on the keybed and is screwed. Therefore, there is a problem that since the positioning precision is not sufficient, the keyboard and the electronic part will come in contact with each other to generate noise, or the keyboard is likely to be damaged.

SUMMARY OF THE INVENTION

It is an object of the present invention to provide an exterior structure of an electronic keyboard instrument in which acoustic characteristics are not detracted, outward appearance is excellent, the exterior structure can easily be produced and assembling precision is high.

To achieve the above object, the present invention provides an exterior structure for an electronic keyboard instrument comprising an extrusion-molded back panel provided on a back surface of an electronic keyboard instrument such as to extend in a direction in which keyboards are arranged, a speaker-mounting hole formed in a substantially upright or inclined wall surface of the back panel, a speaker mounted to the speaker-mounting hole, and a porous speaker cover is mounted in front of the wall surface, wherein a recess groove is formed at an upper portion of the back panel such as to extend in the direction in which the keyboards are arranged, an upper edge of the speaker cover is bent inward to form a locking edge, the locking edge is fitted into the recess groove, and a lower edge of the speaker cover is fixed to a lower portion of the back panel by a screw. Further, a positioning stopper which abuts against a back surface of a keybed of the electronic keyboard instrument and a fixing piece which abuts against a lower surface of the keybed are provided on a lower portion of the back pannel, thereby further enhancing the assembling precision. It is preferable that at least one of upper and lower portions of the back panel is formed with a reinforcing edge for the speaker cover, the reinforcing edge projecting forwardly from the wall surface.

In the present invention, when a thick plate having rigidness made of wood, synthetic resin or the like is provided around periphery of the speaker-mounting hole, excellent acoustic characteristics can be obtained even if the back panel is thin. According to the present invention, it is preferred that an exterior structure for an electronic keyboard instrument comprises an outer surface of the back panel provided with a display of character or drawing, wherein the speaker cover is formed into a size capable of covering substantially the entire surface of the wall surface, and each size or shape of holes of the porous speaker cover is differentiated at a front portion of the speaker and at a front portion of the display, and if desired, each angle of the holes of said porous speaker cover is differentiated at a front portion of said speaker and at a front portion of said display. This feature causes the outward appearance of the electronic keyboard instrument to excellence full of variation.

DETAILED DESCRIPTION OF THE PREFERRED EMBODIMENT

Figure 1:
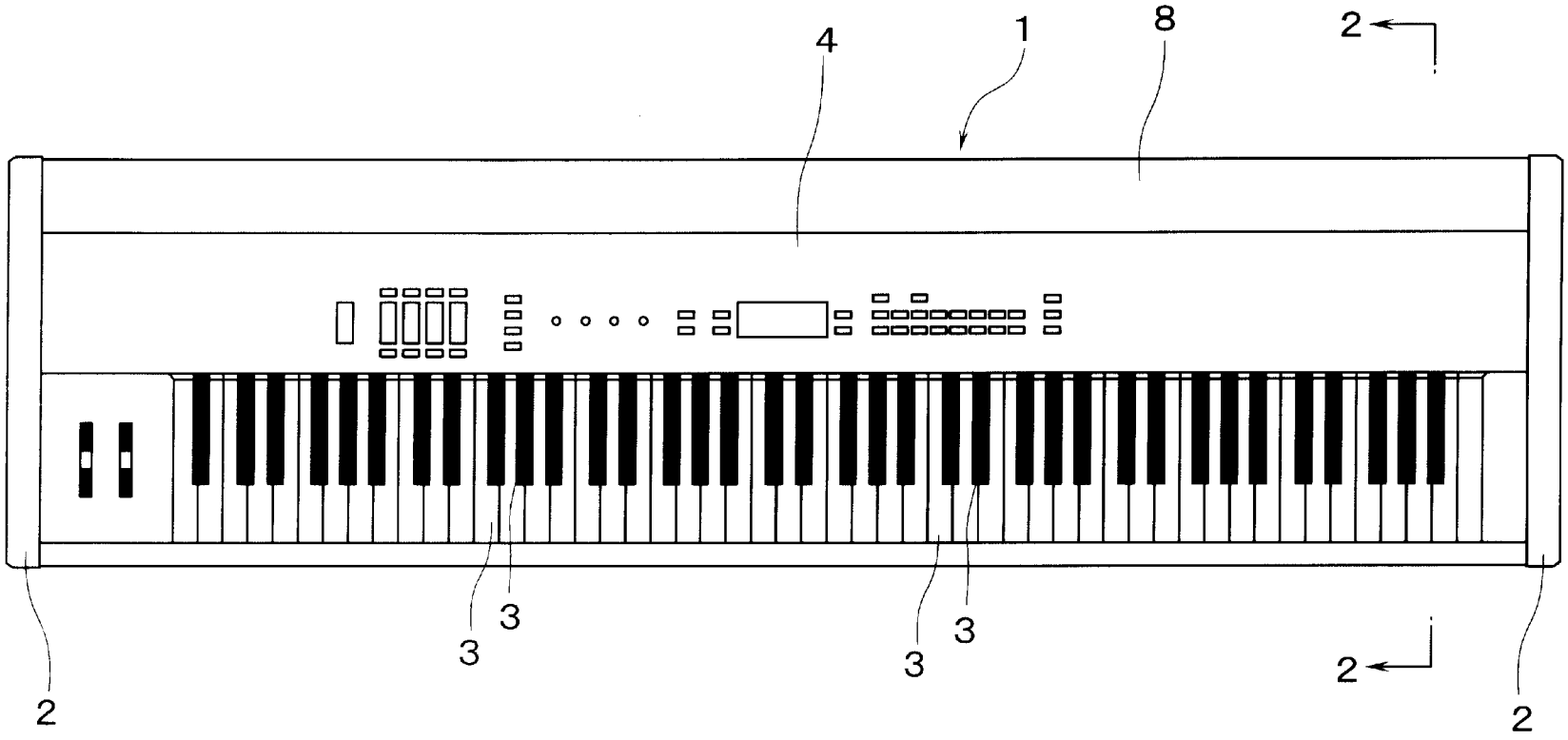
FIG. 1 is a plain view showing an embodiment of the present invention.
Figure 2:
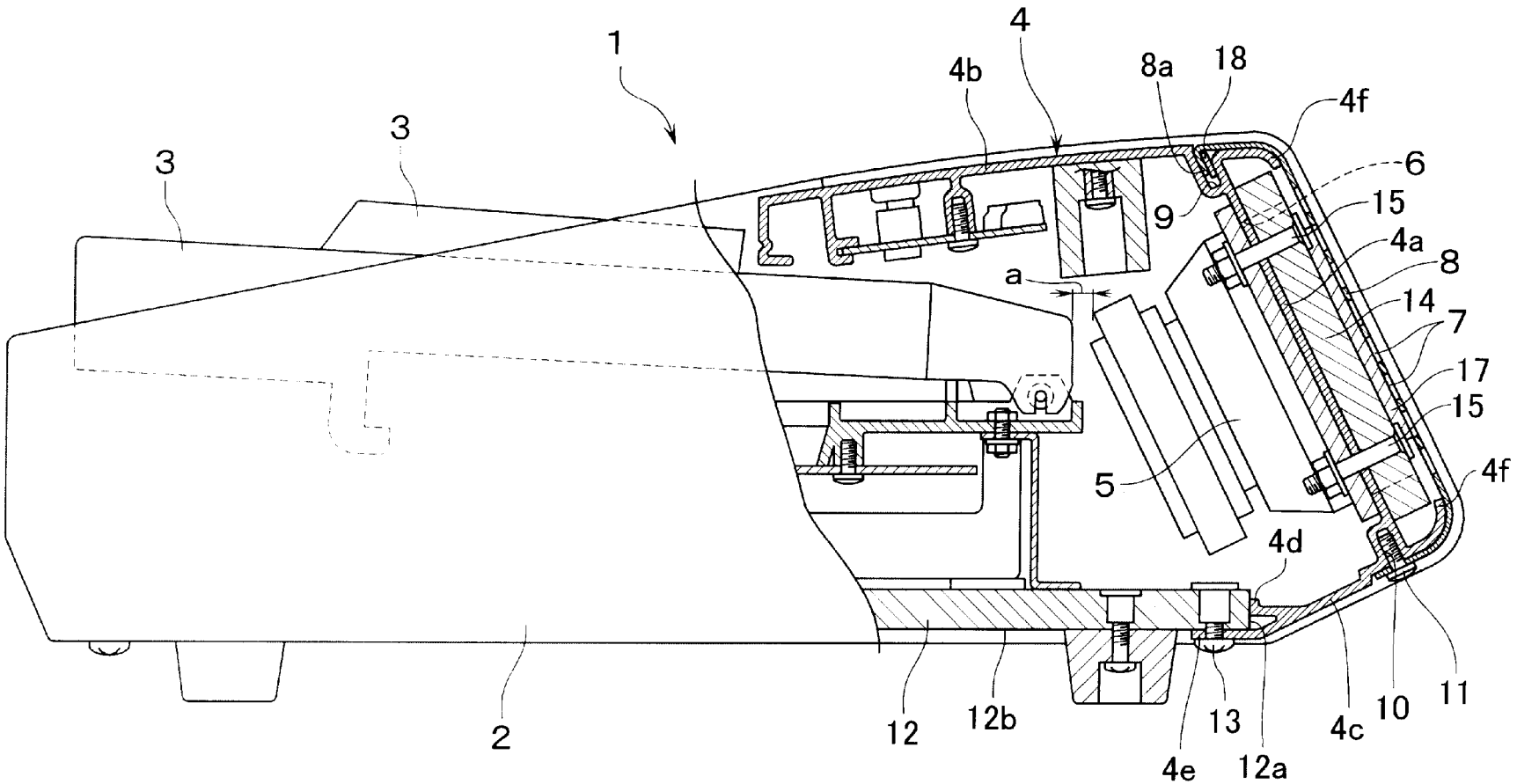
FIG. 2 is a sectional view taken along a line 2—2 in FIG. 1.
Figure 3:
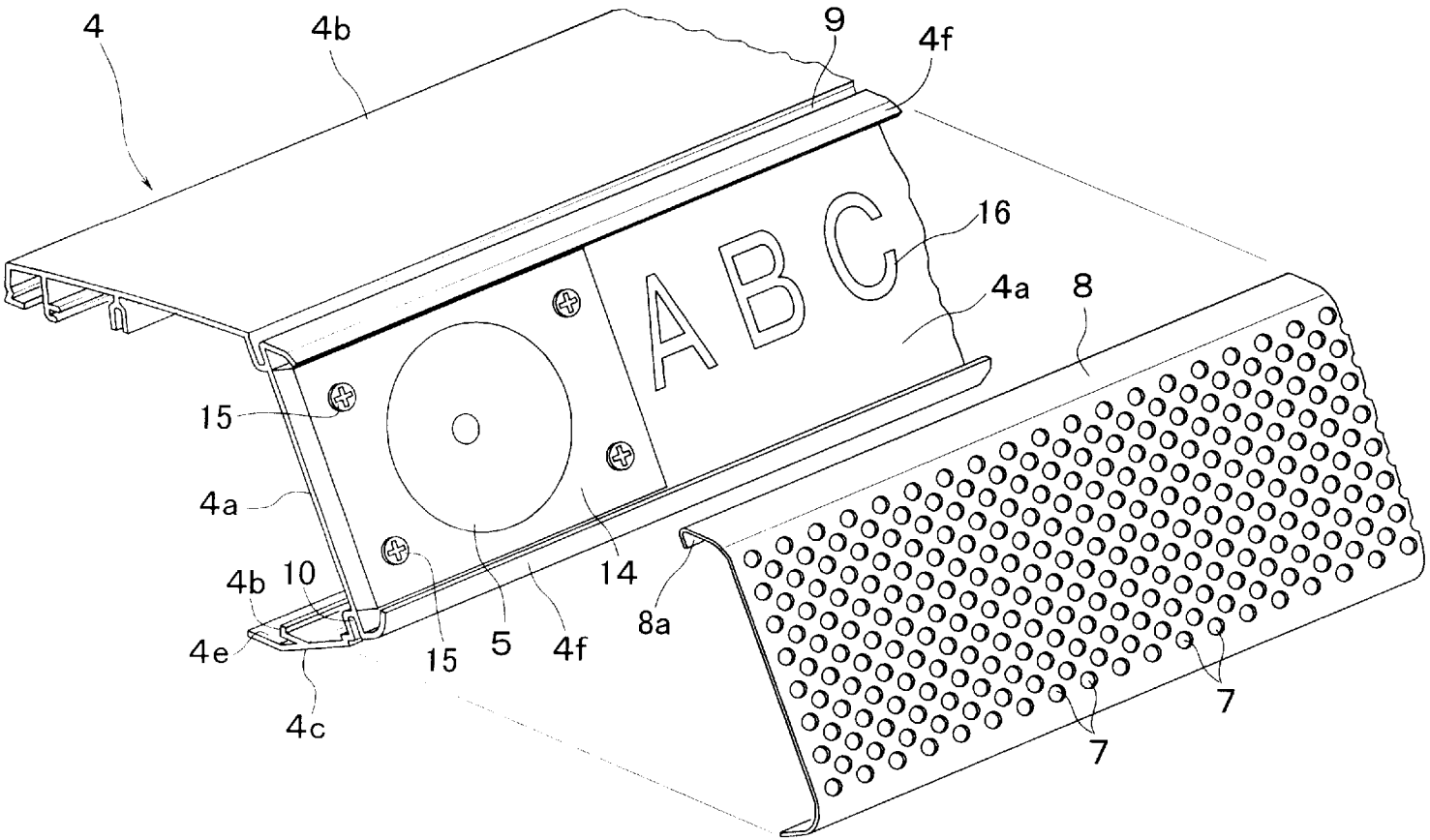
FIG. 3 is a perspective view of an essential portion in FIG. 2.

An embodiment of the present invention will be explained based on the drawings. In FIG. 1, symbol 1 represents an electronic keyboard instrument in which keyboards 3 comprising black and white keyboards arranged between left and right brackets 2 and 2. Symbol 4 represents a back panel of the electronic keyboard instrument 1. If the keyboard 3 is keyed, an electronic circuit provided therein is actuated, and tone is generated from speakers 5 mounted on the back panel 4.

The back panel 4 comprises a longitudinal extrusion-molded metallic material (such as aluminum) having approximately U-shaped cross section integrally comprising a wall surface 4*a* approximately uprightly or slantly provided with slight inclination, an upper cover 4*b* and a lower cover 4*c*. Tow speaker-mounting holes 6 are formed in the back panel 4 at two locations thereof in its longitudinal direction at a distance from each other. A speaker cover 8 having a large number of holes 7 formed by punching metal is provided in front of the wall surface 4*a* for protecting the speakers 5. An upper portion of the back panel 4 is provided with a recess groove 9 along its longitudinal direction, and a lower portion of the back panel 4 is provided with a screw groove 10 along its longitudinal direction. A upper edge of the speaker cover 8 is bent inward to form a locking edge 8*a*, the locking edge 8*a* is fitted into the recess groove 9, and a lower edge of the speaker cover 8 is screwed to the screw groove 10 by a screw 11. A resilient member 18 made of, for example, foamed polyurethane sheet is fitted together with the locking edge 8*a* into the recess groove 9 of the back panel 4. The locking edge 8*a* is pushed against an inner wall of the recess groove 9 by the resilient member 18, thereby exhibiting effect on a prevention of noise caused by vibration or the like of the back panel 4 and the speaker cover 8 and on suppression of the vibration. Since the screw 11 is hidden below the back panel 4 and the screw 11 can not be seen, appearance of the back surface of the electronic keyboard instrument 1 is excellent. Also, since the speaker cover 8 can directly be mounted on the back panel 4 without using special metal hardware or the like, the number of parts is reduced, and the assembling operation is simplified.

Further, the lower cover 4*c* of the lower portion of the back panel 4 is provided with a positioning stopper 4*d* which abuts against a back surface 12*a* constituted by an end surface of a keybed 12 of the electronic keyboard instrument 1, and a fixing piece 4*e* which abuts against a lower surface 12*b* of the keybed 12. The positioning stopper 4*d* is brought into abutment against the back surface 12*a*, and the fixing piece 4*e* is fixed to the lower surface 12*b* by a screw 13. As a result, the positioning of the back panel 4 becomes precise, and even if the clearance a between the speaker 5 and the keyboard 3 is narrow, interference therebetween is prevented, and hence, excellent acoustic characteristics can be obtained. At least one of the upper and lower portions of the wall surface 4*a* of the back panel 4 is also provided with a reinforcing edge 4*f* projecting forwardly from the wall surface 4*a* and an inner surface of the speaker cover 8 abuts against the reinforcing edge 4*f*. Thus, it is possible to prevent the speaker cover 8 from being deformed by impact or the like.

It is preferable that the back panel 4 comprises a thin member so as to lighten the electronic keyboard instrument 1, but if the wall surface 4*a* becomes thinner, the wall surface 4*a* itself is prone to generate vibration, and this vibration may adversely be transmitted to a diaphragm of the speaker 5 to detract the acoustic characteristics. Therefore, in the present invention, a thick plate 14 having rigidness made of synthetic resin, wood or the like is mounted to periphery of the speaker-mounting hole 6 of the back panel 4 so that the thick plate 14 suppresses the vibration of the wall surface 4*a*, thereby solving the inconvenience regarding the detraction of the acoustic characteristics. The thick plate 14 is provided on a front surface, i.e., an outer surface of the wall surface 4*a* and is fastened together with the speaker 5 by a screw 15. Due to this structure, the back panel 4 can be formed thin, and the electronic keyboard instrument 1 can be lightened in weight. By mounting the thick plate 14 around the periphery of the speaker-mounting hole 6, the vibration of the wall surface 4*a* itself can be suppressed, and excellent acoustic characteristics can be obtained. In addition, by providing the thick plate 14 outside the wall surface 4*a* of the back panel 4, a space between the speaker cover 8 and the wall surface 4*a* can be utilized effectively. Therefore, the entire casing can be reduced in size. Further, since the speaker 5 is provided inside the wall surface 4*a*, the precision of the clearance a can be secured. In this case, since the thick plate 14 approaches the speaker cover 8, a cushioning material 17 such as felt, foamed polyurethane or the like is interposed therebetween. The cushioning material 17 also has an action which prevents opposite ends of the speaker cover 8 from being deformed by external force.

Figure 4:
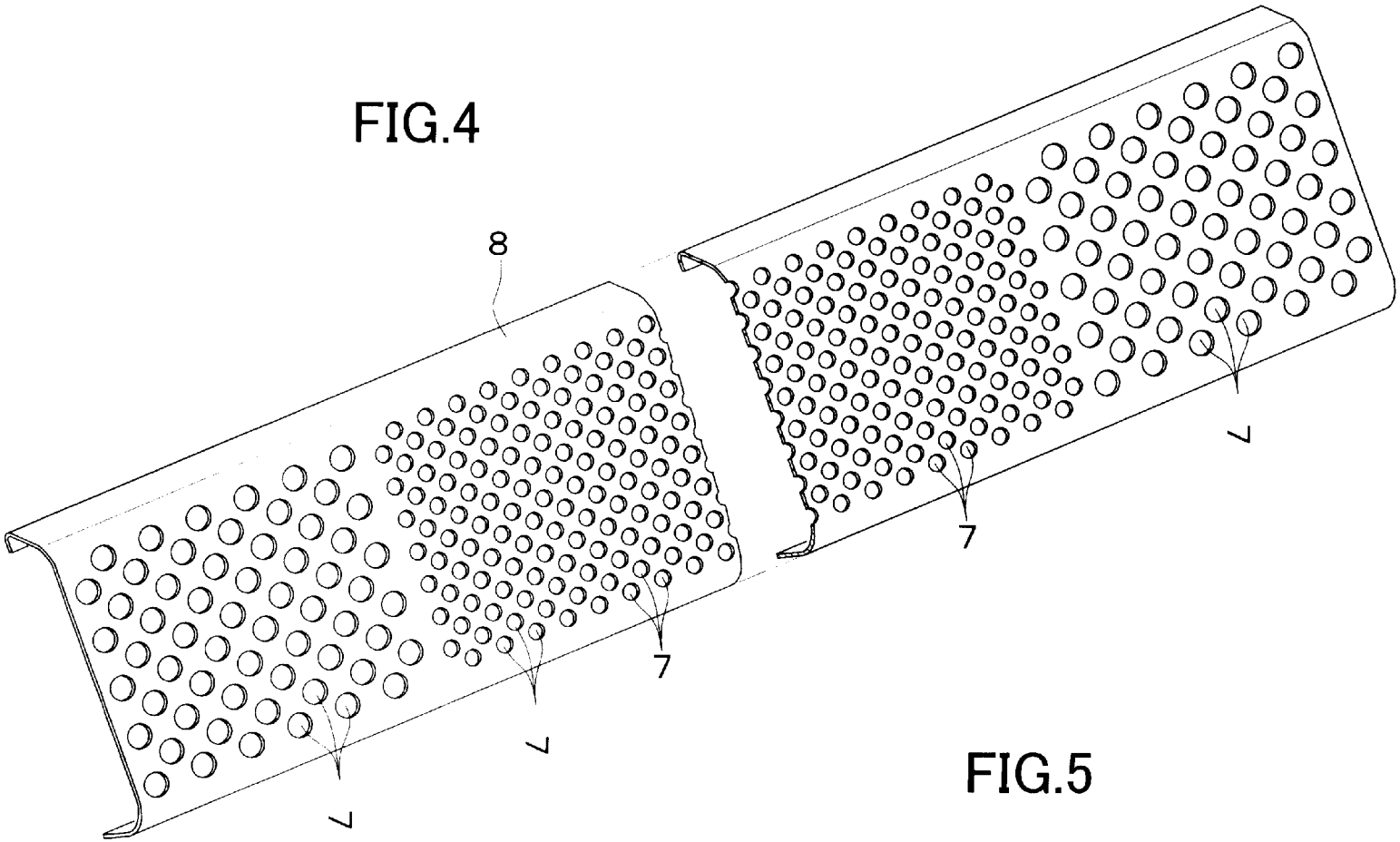
FIG. 4 is a perspective view of a modification of a speaker cover.
Figure 5:
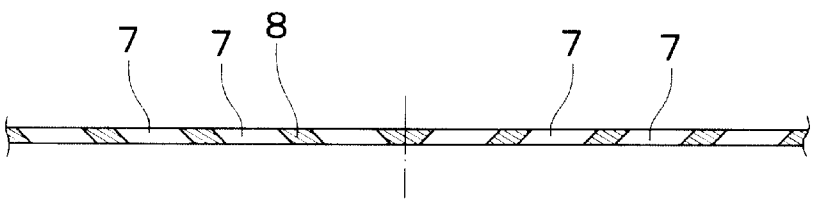
FIG. 5 is a sectional view of another modification of the speaker cover.

A display 16 such as characters or one or more of drawings is printed on the wall surface 4*a* of the back panel 4 for ornamental purposes in many cases. Since such a display 16 is prone to be contaminated or damaged, it was necessary to protect with a transparent film or the like. In the present invention, the speaker cover 8 is however formed into a size capable of covering substantially the entire surface of the wall surface 4*a* to protect the display 16. If necessary, as shown in FIG. 4, the size of the holes 7 of the speaker cover 8 are differentiated at a front portion of the speaker 5 and at a front portion of the display 16 so that shadow is generated on the display 16 of the wall surface 4*a*, and the display 16 is seen accompanying with design variation when the electronic keyboard instrument 1 is seen from back. In the example shown in FIG. 4, the size of the holes 7 of the speaker cover 8 is formed such that a diameter of the hole 7 in front of the speaker 5 is greater than that front of the display 16 such as characters or drawings, but reversely, the size of the holes 7 of the speaker cover 8 may be formed such that a diameter of the hole 7 in front of the speaker 5 is smaller than that front of the display 16. This relation is determined depending on a balance between the acoustic characteristics and a visual sensibility appearing in the display 16 of the wall surface 4*a*. The shape of the hole 7 is not limited to circle, but is arbitrary such as square or triangular. The angle of the hole 7 may be changed at a front portion of the speaker 5 and at a front portion of the display 16 as shown in FIG. 5 so that the wall surface 4*a* can be seen with variation. In this case, it is advantageous because the direction of sound of the speaker 5 can be controlled.

As described above, according to the present invention a recess groove extending in a direction in which keyboards are arranged is formed at an upper portion of the back panel of the electronic keyboard instrument, a locking edge formed at an upper edge of the speaker cover is fitted into the recess groove, and a lower edge of the speaker cover is fixed to a lower portion of the back panel by a screw. Therefore, the speaker cover can be mounted without detracting the outward appearance, excellent acoustic characteristics can be obtained, the structure thereof is simple, and the producing cost is low.

In the embodiments of the present invention, since a positioning stopper which abuts against a back surface of a keybed of the electronic keyboard instrument and a fixing piece which abuts against a lower surface of the keybed are provided at the lower portion, the positioning of the back panel becomes precise, excellent acoustic characteristics can be maintained, the structure thereof is simple, and the producing cost is low. By providing a thick plate having rigidness around the periphery of the speaker-mounting hole of the wall surface of the back panel, the back panel can be thinned and lightened without detracting the acoustic characteristics. Moreover, the speaker cover is formed into a size capable of covering substantially the entire surface of the wall surface, and each size or shape, or each angle of the holes of the porous speaker cover is differentiated at a front portion of the speaker and at a front portion of the display, so that the characters or one or more of drawings depicted on the wall surface of the back panel can be seen accompanying with variation, and thus the aforementioned differentiation attracts attention of the customer.

What is claimed is:

1. An exterior structure for an electronic keyboard instrument comprising an extrusion-molded back panel provided on a back surface of an electronic keyboard instrument such as to extend in a direction in which keyboards are arranged, a speaker-mounting hole formed in an approximately upright or inclined wall surface of said back panel, a speaker mounted to said speaker-mounting hole, and a porous speaker cover is mounted in front of said wall surface, wherein a recess groove is formed at an upper portion of said back panel such as to extend in the direction in which said keyboards are arranged, an upper edge of said speaker cover is bent inward to form a locking edge, said locking edge is fitted into said recess groove, and a lower edge of said speaker cover is fixed to a lower portion of said back panel by a screw.

2. An exterior structure for an electronic keyboard instrument according to claim 1, wherein a positioning stopper which abuts against a back surface of a keybed of an electronic keyboard instrument and a fixing piece which abuts against a lower surface of said keybed are provided at a lower portion of said back panel.

3. An exterior structure for an electronic keyboard instrument according to claim 1 or 2, wherein at least one of upper and lower portions of said back panel is formed with a reinforcing edge for said speaker cover, said reinforcing edge projecting forwardly from said wall surface.

4. An exterior structure for an electronic keyboard instrument comprising an extrusion-molded back panel provided on a back surface of an electronic keyboard instrument such as to extend in a direction in which keyboards are arranged, a speaker-mounting hole formed in an approximately upright or inclined wall surface of said back panel, a speaker mounted to said speaker-mounting hole, and a porous speaker cover is mounted in front of said wall surface, wherein a thick plate having rigidness is provided around periphery of said speaker-mounting hole.

5. An exterior structure for an electronic keyboard instrument according to claim 4, wherein said back panel is formed thin by extrusion-molding using aluminum, and said thick plate is made of wood or synthetic resin.

6. An exterior structure for an electronic keyboard instrument according to claim 4 or 5, wherein said thick plate is provided on an outer surface of said back panel.

7. An exterior structure for an electronic keyboard instrument according to claim 4, wherein an outer surface of said back panel is provided with an display of character or drawing, and said speaker cover is formed into a size capable of covering substantially the entire surface of said wall surface.

8. An exterior structure for an electronic keyboard instrument comprising an extrusion-molded back panel provided on a back surface of an electronic keyboard instrument such as to extend in a direction in which keyboards are arranged, a speaker-mounting hole formed in an approximately upright or inclined wall surface of said back panel, a speaker mounted to said speaker-mounting hole, and a porous speaker cover is mounted in front of said wall surface, wherein an outer surface of said back panel is provided with a display of character or drawing, said speaker cover is formed into a size capable of covering substantially the entire surface of said wall surface, and each size or shape of holes of said porous speaker cover are differentiated at a front portion of said speaker and at a front portion of said display.

9. An exterior structure for an electronic keyboard instrument according to claim 8, wherein each angle of the holes of said porous speaker cover are differentiated at a front portion of said speaker and at a front portion of said display.

* * * * *